US009256161B2

(12) United States Patent
Hayashi et al.

(10) Patent No.: US 9,256,161 B2
(45) Date of Patent: Feb. 9, 2016

(54) PROCESS CARTRIDGE, DEVELOPING DEVICE AND IMAGE FORMING APPARATUS

(71) Applicant: CANON KABUSHIKI KAISHA, Tokyo (JP)

(72) Inventors: Naoki Hayashi, Kawasaki (JP); Masanari Morioka, Yokohama (JP); Yosuke Kashiide, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/724,279

(22) Filed: Dec. 21, 2012

(65) Prior Publication Data

US 2013/0209137 A1 Aug. 15, 2013

(30) Foreign Application Priority Data

Feb. 9, 2012 (JP) ..... 2012-026212

(51) Int. Cl.
*G03G 21/18* (2006.01)
*G03G 15/08* (2006.01)
*G03G 21/16* (2006.01)

(52) U.S. Cl.
CPC ..... *G03G 15/0889* (2013.01); *G03G 21/1623* (2013.01); *G03G 21/1814* (2013.01); *G03G 21/1857* (2013.01); *G03G 21/1853* (2013.01); *G03G 2221/1654* (2013.01);
(Continued)

(58) Field of Classification Search
CPC ..... G03G 21/18
USPC ..... 399/111
See application file for complete search history.

(56) References Cited

U.S. PATENT DOCUMENTS 3,802,776 A * 4/1974 Tchang ..... 356/41
4,648,028 A * 3/1987 DeKlotz et al. ..... 700/83
(Continued)

FOREIGN PATENT DOCUMENTS

CN 1167280 A 12/1997
JP H04-14076 A 1/1992
(Continued)

OTHER PUBLICATIONS

Office Action in Chinese Patent Application No. 201310045104.X, dated Aug. 27, 2014 (with English translation).*
(Continued)

*Primary Examiner* — Clayton E LaBalle
*Assistant Examiner* — Kevin Butler
(74) *Attorney, Agent, or Firm* — Fitzpatrick, Cella, Harper & Scinto

(57) ABSTRACT

A process cartridge detachably mountable to an image forming apparatus includes a rotatable developer carrying member, a rotatable developer feeding member, a rotatable developer stirring member, a developer carrying member gear, a developer feeding member gear, a developer stirring member gear, a transmission member for transmitting a driving force to the developer carrying member, the developer feeding member and the developer stirring member, wherein the transmission member includes a first gear for transmitting the driving force to the developer carrying member gear, a second gear for transmitting the driving force to the developer feeding member gear, and a third gear for transmitting the driving force to the developer stirring member gear, in which the first gear, the second gear and the third gear are integrally molded.

36 Claims, 10 Drawing Sheets

(52) U.S. Cl.
CPC . *G03G 2221/1657* (2013.01); *G03G 2221/183* (2013.01); *G03G 2221/1884* (2013.01)

(56) References Cited

U.S. PATENT DOCUMENTS

| | | | | |
|---|---|---|---|---|
| 4,834,532 | A * | 5/1989 | Yount | 356/41 |
| 4,843,013 | A * | 6/1989 | Chiang | 436/11 |
| 5,193,543 | A * | 3/1993 | Yelderman | 600/310 |
| 5,297,548 | A * | 3/1994 | Pologe | 600/310 |
| 5,575,284 | A * | 11/1996 | Athan et al. | 600/323 |
| 5,692,503 | A * | 12/1997 | Kuenstner | 600/322 |
| 5,803,909 | A * | 9/1998 | Maki et al. | 600/310 |
| 5,919,134 | A * | 7/1999 | Diab | 600/323 |
| 5,957,885 | A * | 9/1999 | Bollish et al. | 604/67 |
| 6,011,985 | A * | 1/2000 | Athan et al. | 600/322 |
| 6,101,349 | A * | 8/2000 | Ohashi et al. | 399/110 |
| 6,174,283 | B1 * | 1/2001 | Nevo et al. | 600/301 |
| 6,223,064 | B1 * | 4/2001 | Lynn et al. | 600/324 |
| 6,229,856 | B1 * | 5/2001 | Diab et al. | 375/316 |
| 6,473,632 | B1 * | 10/2002 | Myers | 600/322 |
| 6,608,980 | B2 | 8/2003 | Murayama et al. | |
| 6,611,320 | B1 * | 8/2003 | Lindberg et al. | 356/40 |
| 6,643,530 | B2 * | 11/2003 | Diab et al. | 600/323 |
| 6,650,917 | B2 * | 11/2003 | Diab et al. | 600/323 |
| 6,658,276 | B2 * | 12/2003 | Kianl et al. | 600/322 |
| 6,704,522 | B2 | 3/2004 | Sasago et al. | |
| 6,708,011 | B2 * | 3/2004 | Nomura et al. | 399/110 |
| 6,714,746 | B2 | 3/2004 | Morioka et al. | |
| 6,763,256 | B2 * | 7/2004 | Kimball et al. | 600/336 |
| 6,879,850 | B2 * | 4/2005 | Kimball | 600/336 |
| 6,898,399 | B2 * | 5/2005 | Morioka et al. | 399/167 |
| 6,937,832 | B2 | 8/2005 | Sato et al. | |
| 6,963,706 | B2 | 11/2005 | Morioka et al. | |
| 6,985,763 | B2 * | 1/2006 | Boas et al. | 600/323 |
| 7,072,602 | B2 * | 7/2006 | Hatori et al. | 399/111 |
| 7,079,787 | B2 | 7/2006 | Ogino et al. | |
| 7,127,192 | B2 * | 10/2006 | Batori et al. | 399/104 |
| 7,200,349 | B2 | 4/2007 | Sato et al. | |
| 7,215,986 | B2 * | 5/2007 | Diab et al. | 600/336 |
| 7,319,894 | B2 * | 1/2008 | Higgins | 600/328 |
| 7,343,186 | B2 * | 3/2008 | Lamego et al. | 600/323 |
| 7,418,225 | B2 * | 8/2008 | Morioka et al. | 399/274 |
| 7,426,355 | B2 * | 9/2008 | Okabe | 399/111 |
| 7,486,907 | B2 * | 2/2009 | Noguchi et al. | 399/110 |
| 7,532,919 | B2 * | 5/2009 | Soyemi et al. | 600/323 |
| 7,565,096 | B2 * | 7/2009 | Murayama | 399/167 |
| 7,826,766 | B2 * | 11/2010 | Okabe | 399/110 |
| 7,853,175 | B2 * | 12/2010 | Kishi | 399/110 |
| 7,873,301 | B2 * | 1/2011 | Ishii | 399/111 |
| 7,912,406 | B2 * | 3/2011 | Okabe | 399/111 |
| 8,027,615 | B2 * | 9/2011 | Okabe | 399/111 |
| 8,041,248 | B2 * | 10/2011 | Okabe | 399/90 |
| 8,041,257 | B2 * | 10/2011 | Okabe | 399/110 |
| 8,116,660 | B2 * | 2/2012 | Watanabe | 399/111 |
| 8,135,304 | B2 | 3/2012 | Abe et al. | |
| 8,265,521 | B2 * | 9/2012 | Okabe | 399/110 |
| 8,270,876 | B2 | 9/2012 | Morioka et al. | |
| 8,275,286 | B2 | 9/2012 | Ueno et al. | |
| 8,280,278 | B2 | 10/2012 | Ueno et al. | |
| 8,295,734 | B2 | 10/2012 | Ueno et al. | |
| 8,391,747 | B2 * | 3/2013 | Kim et al. | 399/111 |
| 8,442,412 | B2 * | 5/2013 | Imaizumi et al. | 399/90 |
| 8,452,210 | B2 | 5/2013 | Ueno et al. | |
| 8,620,197 | B2 * | 12/2013 | Kawakami | 399/263 |
| 8,666,280 | B2 * | 3/2014 | Mizuno et al. | 399/111 |
| 2004/0034293 | A1 * | 2/2004 | Kimball | 600/323 |
| 2004/0034294 | A1 * | 2/2004 | Kimball et al. | 600/323 |
| 2004/0122300 | A1 * | 6/2004 | Boas et al. | 600/323 |
| 2005/0019936 | A1 * | 1/2005 | Samsoondar et al. | 436/80 |
| 2007/0071482 | A1 * | 3/2007 | Okabe | 399/90 |
| 2007/0093701 | A1 * | 4/2007 | Myers et al. | 600/323 |
| 2007/0160380 | A1 * | 7/2007 | Imaizumi et al. | 399/90 |
| 2007/0160384 | A1 * | 7/2007 | Sakurai et al. | 399/110 |
| 2007/0160385 | A1 * | 7/2007 | Noguchi et al. | 399/110 |
| 2007/0160388 | A1 * | 7/2007 | Yoshimura et al. | 399/111 |
| 2007/0286632 | A1 * | 12/2007 | Okabe | 399/90 |
| 2008/0097173 | A1 * | 4/2008 | Soyemi et al. | 600/310 |
| 2008/0159775 | A1 * | 7/2008 | Koishi et al. | 399/90 |
| 2008/0240796 | A1 | 10/2008 | Morioka et al. | |
| 2009/0326342 | A1 * | 12/2009 | Huiku | 600/322 |
| 2010/0054811 | A1 * | 3/2010 | Ishii | 399/167 |
| 2010/0080610 | A1 * | 4/2010 | Yoshizumi | 399/111 |
| 2010/0098457 | A1 * | 4/2010 | Watanabe | 399/111 |
| 2010/0099964 | A1 * | 4/2010 | O'Reilly et al. | 600/323 |
| 2010/0198029 | A1 * | 8/2010 | Wang | 600/323 |
| 2010/0226682 | A1 * | 9/2010 | Tanaka et al. | 399/106 |
| 2010/0298675 | A1 * | 11/2010 | Al-Ali et al. | 600/322 |
| 2011/0028809 | A1 * | 2/2011 | Goodman | 600/322 |
| 2011/0038649 | A1 * | 2/2011 | Miyabe et al. | 399/119 |
| 2011/0103832 | A1 | 5/2011 | Hayashi et al. | |
| 2011/0190613 | A1 * | 8/2011 | Zhang et al. | 600/328 |
| 2012/0029301 | A1 * | 2/2012 | Battista, Jr. | 600/300 |
| 2012/0116175 | A1 * | 5/2012 | Al-Ali et al. | 600/300 |
| 2012/0123231 | A1 * | 5/2012 | O'Reilly | 600/340 |
| 2012/0179006 | A1 * | 7/2012 | Jansen et al. | 600/301 |
| 2012/0201566 | A1 | 8/2012 | Abe et al. | |
| 2012/0209095 | A1 * | 8/2012 | Huiku | 600/322 |
| 2012/0289797 | A1 * | 11/2012 | Al-Ali | 600/316 |
| 2013/0064569 | A1 | 3/2013 | Ueno et al. | |
| 2013/0121724 | A1 * | 5/2013 | Nittani | 399/111 |
| 2013/0164028 | A1 * | 6/2013 | Morioka et al. | 399/111 |
| 2013/0164031 | A1 | 6/2013 | Ueno et al. | |

FOREIGN PATENT DOCUMENTS

| | | |
|---|---|---|
| JP | 10-39715 | 2/1998 |
| JP | 2001-209231 A | 8/2001 |
| JP | 2001-249604 | 9/2001 |
| JP | 2004-126003 A | 4/2004 |
| JP | 2010-02556 A | 1/2010 |
| JP | 2010-231183 | 10/2010 |

OTHER PUBLICATIONS

Nov. 17, 2015 Office Action in Japanese Patent Application No. 2012-026212.

* cited by examiner

PROCESS CARTRIDGE, DEVELOPING DEVICE AND IMAGE FORMING APPARATUS

FIELD OF THE INVENTION AND RELATED ART

This application claims priority from Japanese Patent Application No. 026212/2012 filed Feb. 9, 2012, which is hereby incorporated by reference.

The present invention relates to a process cartridge for use with an image forming apparatus of an electrophotographic type, a developing device therefor, and an image forming apparatus.

The image forming apparatus forms an image on a recording material using an image forming process of the electrophotographic type, an electrostatic recording type, a magnetic recording system or the like. Examples of such an image forming apparatus include a copying machine, a printer (laser beam printer or LED printer for example), a facsimile machine, a complex function machine thereof, a word processor and so on.

The recording material is paper or OHT sheet or the like on which the image is formed by the image forming apparatus.

The process cartridge is a unit in which an image bearing member for bearing a latent image, and at least one of image forming process means actable on the image bearing member such as charging means, developing means and cleaning means are unified. It is detachably mountable to a main assembly of the image forming apparatus. The process cartridge can be mounted and demounted relative to the main assembly of the apparatus by a user. Therefore, the maintenance of the image forming apparatus is easy.

The image bearing member is an electrophotographic photosensitive member in the electrophotographic type, a dielectric member for electrostatic recording in the electrostatic recording type, and a magnetic member for magnetic recording in the magnetic recording system. The main assembly of the apparatus is a structural portion of the image forming apparatus except for the process cartridge.

Therefore, the process cartridge includes a unit which is demountable from the main assembly of the apparatus and in which at least the image bearing member and the developing means as the image forming process means are unified. The process cartridge including the image bearing member and the developing means is called "integral type cartridge". A process cartridge including the image bearing member and process means other than the developing means is called "separable type". In the separable type, the developing means is provided in another unit, that is, a developing unit, and the image is formed by a combination of the process cartridge and such a developing unit.

In the present invention, the process cartridge includes a rotatable image bearing member on which a developer image to be transferred onto the recording material is formed, and the developing device for developing the latent image formed on the image bearing member with a developer.

The developing device includes developing means for developing the latent image formed on the image bearing member with the developer. The developing device is included in the integral type process cartridge. Or, it is a developing cartridge which is independently mountable to and dismountable from the main assembly of the apparatus. Or, it is independently mounted and fixed to the main assembly of the apparatus.

In the following, the description will be made as to an exemplary image forming apparatus which is an electrophotographic image forming apparatus such as a printer using the electrophotographic process. The image forming apparatus electrically charges uniformly the rotatable electrophotographic photosensitive member (photosensitive drum) as the image bearing member and forms the latent image by selective exposure of the photosensitive drum. The latent image is visualized with the developer (toner) into a toner image. The toner image is transferred onto the recording material. Or, it is transferred onto the recording material through an intermediary transfer member.

The toner image transferred onto the recording material is heated and/or pressed so as to be fixed on the recording material into a fixed image. Then, the photosensitive drum is cleaned by removing remaining toner from the surface thereof by the cleaning means to be prepared for the next image forming operation.

Conventionally, such an image forming apparatus requires toner supply and maintenance operations for various process means. In order to make a toner supplying operation and/or the maintenance operations, all or a part of the photosensitive drum, the charging means, the developing means, the cleaning means and so on are unified into a cartridge. The process cartridge is detachably mountable to the main assembly of the apparatus (cartridge type) (Japanese Laid-open Patent Application 2010-231183).

With the process cartridge type, the maintenance operations can be carried out in effect by exchange of the cartridge, and therefore, the operationality can be improved remarkably. The cartridge can be exchanged by the user. When the cartridge is to be exchanged, the user ordinarily takes out the process cartridge from the main assembly of the apparatus, and a new process cartridge is loaded.

A known process cartridge integrally including the photosensitive drum and the developing means has a structure shown in FIG. 9. The process cartridge T comprises a developing device 119 and a cleaning unit 118.

The developing device 119 includes a toner accommodating portion 129*c* accommodating the toner, a developer carrying member (developing roller) 116 as the developing means for developing the latent image on the photosensitive drum 114. It further comprises a developer feeding member the toner supplying roller) 133 for supplying the toner to the developing roller 116, and a developing blade 130 for regulating a thickness of the toner layer applied to the developing roller 116. In addition, it includes a toner stirring member 147 for stirring and supplying the toner to the toner supplying roller 133.

As shown in FIG. 10, the driving force for the developing roller 116, the toner supplying roller 133 and the toner stirring member 147 is received from a driving source (unshown) of the main assembly side of the apparatus by an input coupling 142*a* provided on a driving side end surface of the developing drive input gear 142 with respect to the axial direction.

The driving force is transmitted from a first gear portion 142*b* of the developing drive input gear 142 integral with the development input coupling 142*a* to a developing roller gear 140 fixed on the core metal 116*a* of the developing roller 116 to rotate the developing roller 116.

In addition, it is transmitted from a second gear portion 142*c* of the developing drive input gear 142 to a toner supplying roller gear 141 fixed to the core metal 133*a* of the toner supplying roller 133 to rotate the toner supplying roller 133.

Furthermore, an engaging portion 142*d* of the development input gear 142 and a portion-to-be-engaged 143*a* of an idler gear 143 are engaged so that the idler gear 143 receives the driving force. The driving force is transmitted the idler gear 143 to a toner stirring gear 146 fixed to the core metal 147*a* of the toner stirring member 147 to rotate is toner stirring member 147.

In this conventional structure, when the driving force transmitted from the main assembly of the apparatus is transmitted to the toner stirring member 147, the drive transmission is effected from the developing drive input gear 142 to the toner stirring gear 146 through an idler gear 143 which is not the developing drive input gear 142.

On the other hand, the image forming apparatus is recently required to be downsized, and therefore, the downsizing of the cartridge which occupies a large space in the main assembly of the apparatus is desired. For the downsizing of the cartridge, downsizing of the constituent elements, reduction of the number of parts and efficient dispositions of the parts are desired.

SUMMARY OF THE INVENTION

Accordingly, it is a principal object of the present invention to provide a process cartridge, a developing cartridge and a developing device in which a drive transmission path to a toner stirring member is simplified, downsized and reduced in cost, while stabilizing the drive transmission during the image forming operation.

According to an aspect of the present invention, there is provided a process cartridge detachably mountable to a main assembly of an image forming apparatus for forming an image on a recording material, said process cartridge comprising a rotatable image bearing member for carrying a latent image; and a developing device for developing the latent image with a developer, wherein said developing device includes, a rotatable developer carrying member for developing the latent image formed on said image bearing member with a developer, a rotatable developer feeding member for supplying the developer to said developer carrying member, a developer accommodating chamber for accommodating the developer, a rotatable developer stirring member for stirring the developer accommodated in said developer accommodating chamber, a developer carrying member gear provided on a shaft of the developer carrying member, a developer feeding member gear provided on a shaft of the developer feeding member, a developer stirring member gear provided on a shaft of the developer stirring member, and a transmission member for transmitting a driving force to said developer carrying member, said developer feeding member and said developer stirring member, wherein said transmission member includes a first gear for transmitting the driving force to said developer carrying member gear, a second gear for transmitting the driving force to said developer feeding member gear, and a third gear for transmitting the driving force to said developer stirring member gear, in which said first gear, said second gear and said third gear are integrally molded.

These and other objects, features, and advantages of the present invention will become more apparent upon consideration of the following DESCRIPTION OF THE PREFERRED EMBODIMENTS of the present invention, taken in conjunction with the accompanying drawings.

These and other objects, features and advantages of the present invention will become more apparent upon a consideration of the following description of the preferred embodiments of the present invention taken in conjunction with the accompanying drawings.

DESCRIPTION OF THE EMBODIMENTS

[Embodiment 1]

Referring to FIGS. 1-8, a first embodiment of the present invention will be described. An electrophotographic image forming apparatus of this embodiment is a full-color electrophotographic image forming apparatus to which four process cartridges each including a developing device are detachably mountable. However, the number of the kinds of the process cartridges mountable to the image forming apparatus is not limited to four. If necessary, it may be properly changed. For example, in the case of an image forming apparatus for forming a monochromatic image, the kind of the process cartridge is one.

In this embodiment, the image forming apparatus is a printer. However, the present invention is not limited to this example. For example, the present invention is applicable to a copying machine, a facsimile machine, or another image forming apparatus such as a complex machine.

(General Arrangement of Image Forming Apparatus)

Figure 2:
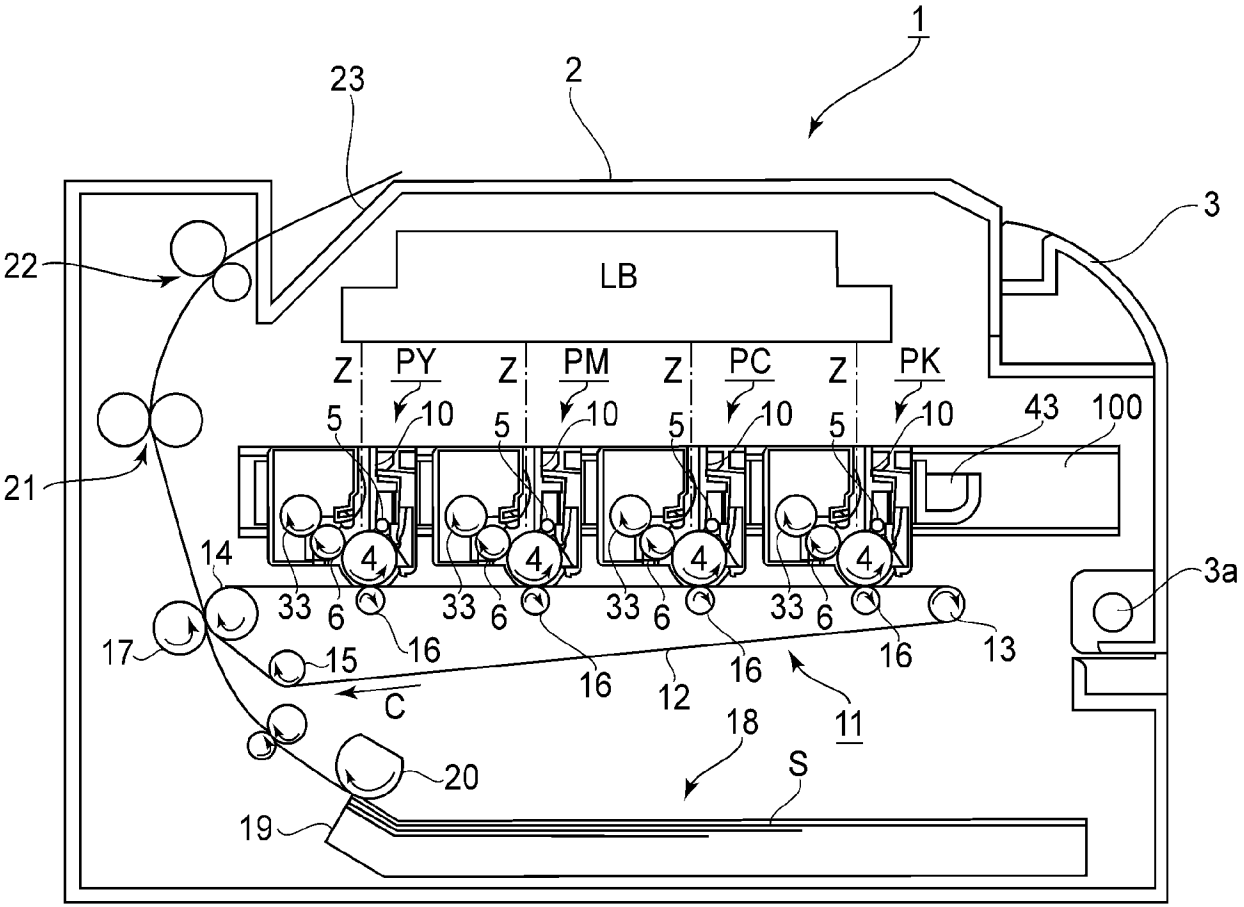
FIG. 2 is a schematic sectional view of an example of an image forming apparatus.

FIG. 2 is a schematic section of the image forming apparatus of this embodiment. The image forming apparatus 1 is a four full-color laser beam printer using an electrophotographic process and carries out a color image formation on a recording material S. It forms an image on the recording material S in the form of a sheet on the basis of image information (electrical image signal) inputted to a control circuit portion (unshown) from an external host apparatus (unshown). The external host apparatus is a personal computer, an image reading apparatus, a facsimile machine, a network or the like.

The image forming apparatus 1 is a process cartridge type apparatus to which a process cartridge (cartridge) P is dismountably mounted, and a color image is formed on the recording material S.

Here, the side of the image forming apparatus 1 provided with an opening and closing door 3 is a front side, and the side opposite the front side is a rear side. The left and right of the image forming apparatus 1 are left-hand and right-hand sides as seen from the front side. The upside and downside are based on the direction of gravity. In the image forming apparatus 1 of this embodiment, the righthand side is a driving side, and the left side is a non-driving side.

In the main assembly of the apparatus 2, a first cartridge PY, a second cartridge PM, a third cartridge PC and a fourth cartridge PK are arranged in the horizontal direction. The first-fourth cartridges P (PY, PM, PC, PK) have similar electrophotographic processing mechanisms, although the colors of the developers (toners) therein are different.

In the state that the first-fourth cartridges P (PY, PM, PC, PK) are mounted in a predetermined manner in the main assembly 2 of the apparatus 2 (FIG. 2), each cartridge can receive a rotational force from a drive outputting portion (unshown driving source) of the main assembly 2 of the apparatus. Each cartridge can receive a bias voltage (charging bias voltage, developing bias voltage or the like) from a bias output portion (unshown voltage source) of the main assembly 2.

Figure 3:
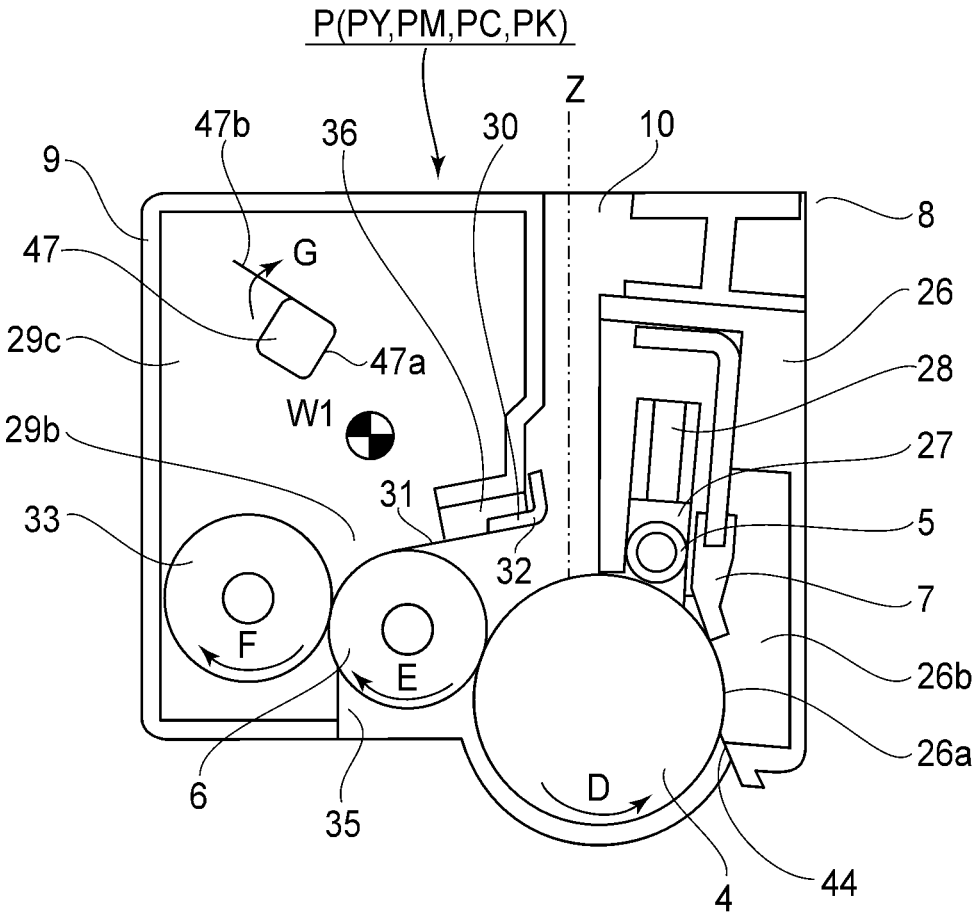
FIG. 3 is a schematic sectional view of a process cartridge.
Figure 4:
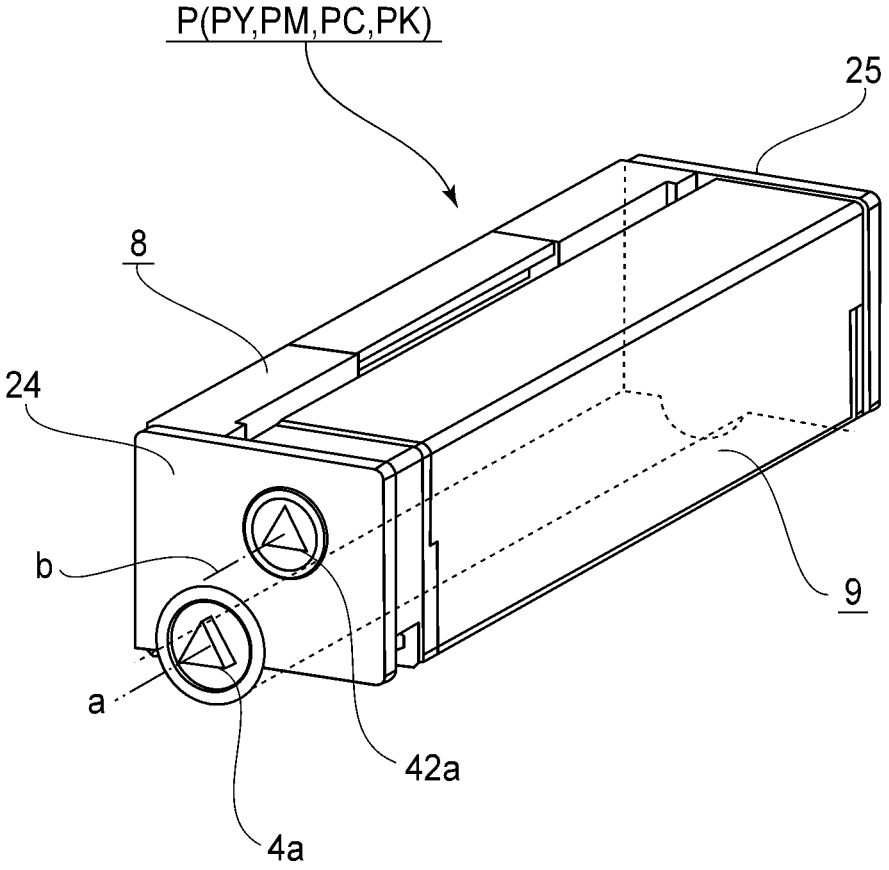
FIG. 4 is a perspective view of an outer appearance of the process cartridge.

FIG. 3 is a schematic enlarged cross-sectional view of the cartridge P of this embodiment, and FIG. 4 is a schematic perspective appearance as seen from a driving side (right side) of the cartridge P. Detail structures of the cartridge P will be described hereinafter, and it generally comprises a cleaning unit 8 and a developing device (developing unit) 9, which are connected with each other by a shaft W1.

The cleaning unit 8 includes a drum type electrophotographic photosensitive member (photosensitive drum) 4 as a rotatable image bearing member, on which a developer image to transferred onto the recording material S is formed. The cleaning unit 8 also includes charging means 5 and cleaning means 7 as image forming process means actable on the photosensitive drum 4. The charging means 5 in this embodiment is a contact type charging roller, and the cleaning means 7 is a cleaning blade. The photosensitive drum 4, the charging roller 5 and the cleaning blade 7 are mounted to a cleaner container (cleaning frame) 26 of the cleaning unit 8.

The developing device 9 is a contact-type developing device using one component non-magnetic developer (toner). In the developing device frame (developing container) 29 of the developing device 9, a developer carrying member (developing roller) 6 is provided as the developing means. More specific structures of the developing device 9 and the process cartridge P will be described hereinafter.

The first cartridge PY accommodates yellow (Y) toner in a developing device frame 29 to form the yellow color toner image on a surface of the photosensitive drum 4. The second cartridge PM accommodates magenta (M) toner in a developing device frame 29 to form a magenta color toner image on a surface of the photosensitive drum 4. The third cartridge PC accommodates cyan (C) toner in a developing device frame 29 to form a cyan color toner image on a surface of the photosensitive drum 4. The fourth cartridge PK accommodates black (K) toner in a developing device frame 29 to form black color toner image on a surface of the photosensitive drum 4.

Above the first-fourth cartridges P (PY, PM, PC, PK), a laser scanner unit LB as the exposure means is provided. The laser scanner unit LB outputs a laser beam Z corresponding to the image information. The laser beam Z travels through an exposure window 10 of the cartridge P, and the surface of the photosensitive drum 4 is scaningly exposed to the laser beam Z.

Below the first-fourth cartridges P (PY, PM, PC, PK), there is provided an intermediary transfer belt unit 11 as the transfer member. The intermediary transfer belt unit 11 comprises a flexible transfer belt 12 which is stretched around a driving roller 13, a turning roller 14 and a tension roller 15.

Lower surfaces of the photosensitive drums 4 of the first-fourth cartridges P (PY, PM, PC, PK) are contacted to an upper surface of the transfer belt 12. The contact portions therebetween are primary transfer portions. Inside of the transfer belt 12, there are provided primary transfer rollers 16 opposed to the photosensitive drums 4. A secondary transfer roller 17 is urged toward the turning roller 14 through the transfer belt 12. The contact portion between the transfer belt 12 and the secondary transfer roller 17 is a secondary transfer portion.

A feeding unit 18 is provided below the intermediary transfer belt unit 11. The feeding unit 18 includes a sheet feeding tray 19 accommodating a stack of recording material S and a sheet feeding roller 20. As shown in FIG. 2, in an upper left part of the inside of the main assembly 2, there are provided a fixing unit 21 and a discharging unit 22. An upper surface of the main assembly 2 functions as a discharging tray 23. The recording material S is subjected to a fixing operation of the fixing means provided in the fixing unit 21 so that the toner image is fixed, and then is discharged to the discharging tray 23.

(Image Forming Operation)

The operation for forming a full-color image is as follows. The photosensitive drums 4 of the first-fourth cartridges P (PY, PM, PC, PK) are rotated at a predetermined speed in the direction of an arrow D in FIG. 3 (counterclockwise direction in FIG. 2). The transfer belt 12 is also rotated codirectionally with the peripheral movement of the rotation of the photosensitive drum (in the direction of arrow C in FIG. 2) at a speed corresponding to the speed of the photosensitive drum 4. The laser scanner unit LB is also actuated.

In synchronism with drive of the laser scanner unit LB, in the cartridge, is charging roller 5 uniformly charges the surface of the photosensitive drum 4 to a predetermined polarity and potential. The laser scanner unit LB scans the surface of the photosensitive drum 4 with the laser beam in accordance with the image signal for each color. By this, an electrostatic latent image corresponding to the image signal is formed on the surface of each photosensitive drum 4. The electrostatic latent image formed is developed by a developing roller 6 which is rotated at a predetermined speed in the direction of an arrow E in FIG. 3.

Through such an electrophotographic image forming process operation, a yellow color toner image corresponding to a yellow component of the full-color image is formed on the photosensitive drum 4 of the first cartridge PY. The toner image is primary transferred onto the transfer belt 12.

Similarly, a magenta toner image corresponding to a magenta component of the full-color image is formed on the photosensitive drum 4 of the second cartridge PM. The toner image is primary transferred superimposingly on the yellow color toner image already on the transfer belt 12.

Similarly again, a cyan toner image corresponding to a cyan component of the full-color image is formed on the photosensitive drum 4 of the third cartridge PC. The toner image is primary transferred superposingly on the yellow color and magenta color toner images already on the transfer belt 12.

Further similarly, a black toner image corresponding to a black component of the full-color image is formed on the photosensitive drum 4 of the fourth cartridge PK. The toner image is primary transferred superposingly on the yellow color, magenta color, cyan color toner images already on the transfer belt 12.

In this manner, a four full-color image (unfixed) of yellow color, magenta color, cyan color and black color is formed on the transfer belt 12. On the other hand, a recording material S is singled out of the feeding unit 18 at predetermined control timing. The recording material S is introduced to the secondary transfer portion where the secondary transfer roller 17 and the transfer belt 12 are contacted to each other at predetermined control timing.

By this, the superimposed four color toner image is transferred sequentially all together from the transfer belt 12 onto the surface of the recording material S in the process of the feeding of the recording material S in the secondary transfer portion. The recording material S departing the secondary transfer portion is separated from the transfer belt 12 and is introduced to the fixing unit 21 where the toner image is fixed by the fixing means, and is discharged to the discharging tray 23 as a print.

(Structure of Cartridge P)

As shown in FIG. 4, the cartridge P (PY, PM, PC, PK) is elongated in the direction of a rotational axis a of the photosensitive drum 4 and includes the cleaning unit 8, the developing device 9, a driving side covering member 24 and a non-driving side covering member 25.

As shown in FIG. 3, the cleaning unit 8 comprises a photosensitive drum 4, a charging roller 5, a cleaner container (cleaning frame) 26 including a cleaning blade 7.

The photosensitive drum 4 is supported rotatably by the driving side covering member 24 and the non-driving side covering member 25. The photosensitive drum 4 receives a driving force from the motor (driving source (unshown)) of the main assembly 2 through a drum driving coupling 4*a* fixed to one end portion of the photosensitive drum 4 with respect to the rotational axis direction thereby to rotate in the direction of the arrow D.

The charging roller 5 is rotatably supported at the opposite end portions by charging roller bearings 27 of the cleaner container 26, and contacts the surface of the photosensitive drum 4 to rotate relative to the photosensitive drum, and is supplied with the charging bias voltage to charge the surface of the photosensitive drum 4. At this time, in order to charge the surface of the photosensitive drum uniformly, the charging roller 5 is pressed against the surface of the photosensitive drum 4 by urging springs 28.

The cleaning blade 7 is fixed to the cleaner container 26, and a free end portion of the elastic rubber portion is contacted to the photosensitive drum 4 counterdirectionally relative to a rotational moving direction (arrow D direction in FIG. 3). In the image forming operation, the untransferred toner remaining on the photosensitive drum 4 is scraped off by the cleaning blade 7 (cleaning member) to clean the surface of the photosensitive drum 4. In order to scrape the untransferred toner sufficiently, the free end of the cleaning blade 7 is contacted to the surface of the photosensitive drum 4 at a predetermined pressure.

The untransferred toner scraped off the surface of the photosensitive drum 4 by the cleaning blade 7 is collected into a residual toner accommodation chamber (residual developer accommodating chamber) 26*b* of the cleaner container 26 as residual toner through an opening 26*a* and is stored there. To the cleaner container 26, a flexible residual toner collection sheet (flexible sheet) 44 is fixed and is extended in the longitudinal direction of the photosensitive drum 4 to prevent leakage of the residual toner through a gap between the photosensitive drum 4 and the cleaning blade 7. In addition, at the opposite longitudinal end portions of the cleaning blade 7, cleaning blade end portion sealing members (unshown) are provided.

The developing device 9 is supported swingably by a shaft W1 between the driving side covering member 24 and the non-driving side covering member 25. That is, the cleaning device 8 and the developing device 9 are connected with each other by the shaft W1. The developing device 9 is rotationally urged about the shaft W1 by an urging member (unshown) so that the developing roller 6 is contacted to the photosensitive drum 4 in the cleaning device 8 at a predetermined urging force, in a free state.

The developing roller 6, the developer supplying roller 33 and the developer stirring member 47 are rotated in the directions of arrows E, F and G by the driving force from the motor (driving source (unshown)) of the main assembly 2 through the developing drive coupling 42*a* provided co-axially with an axis b of the shaft W1 on the driving side covering member 24.

(Mounting and Demounting of the Cartridge P)

The mounting and demounting operation of the cartridge P (PY, PM, PC, PK) relative to the main assembly 2 will be described. When the cartridge is to be exchanged in the image forming apparatus of this embodiment, the cartridge is on a cartridge tray 43 of a drawer type in a front access manner. The tray 43 supports the cartridge demountably. The cartridge tray 43 is movable along a rail member 100 between a drawn-out position (outside position) in which the cartridges P can be mounted and demounted in an outside of the main assembly 2, and a mounted position in which the cartridges P are set in the main assembly 2.

Figure 5:
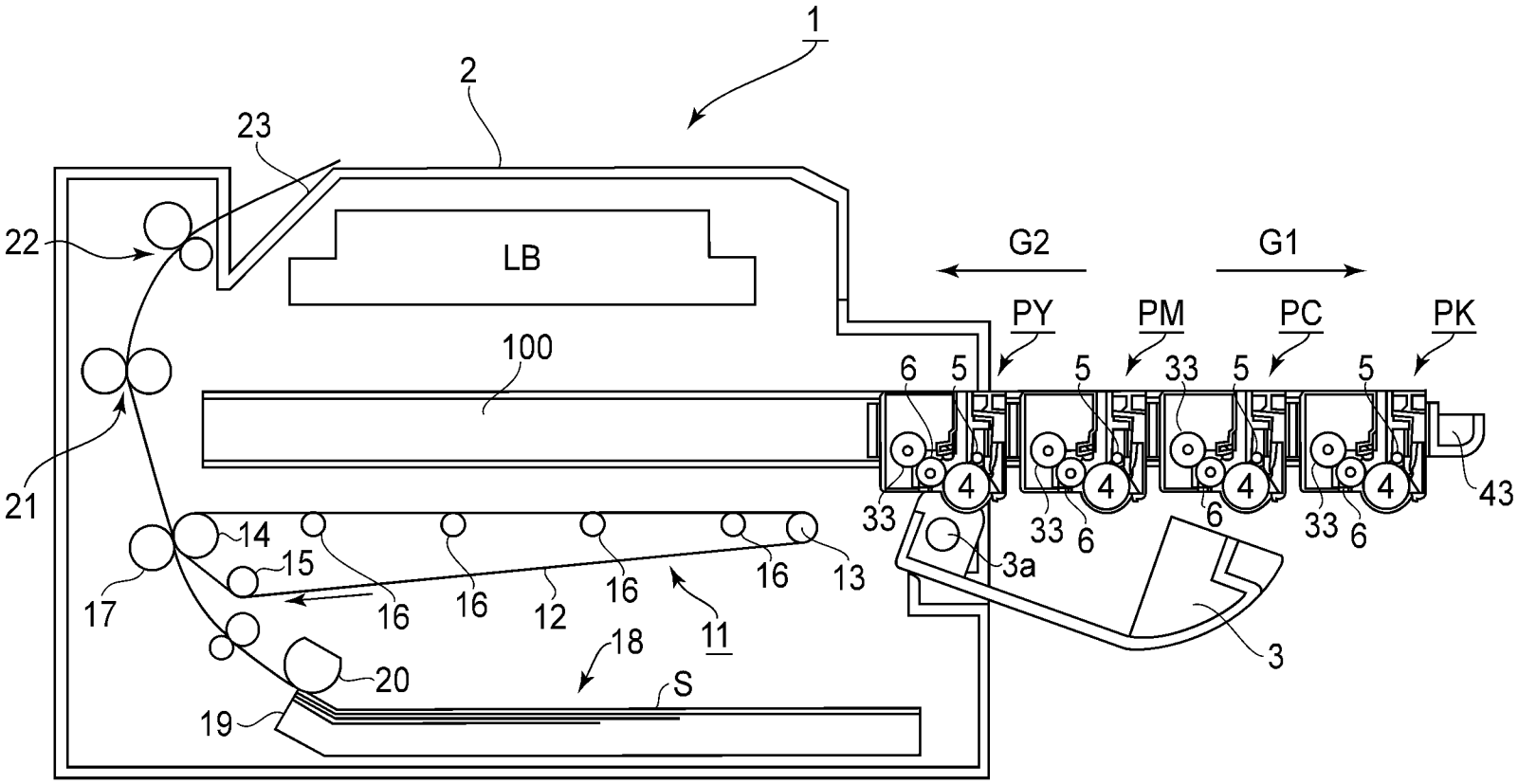
FIG. 5 is a schematic section 1 illustrating a mounting and demounting structure of the process cartridge relative to the main assembly of the image forming apparatus.
Figure 6:
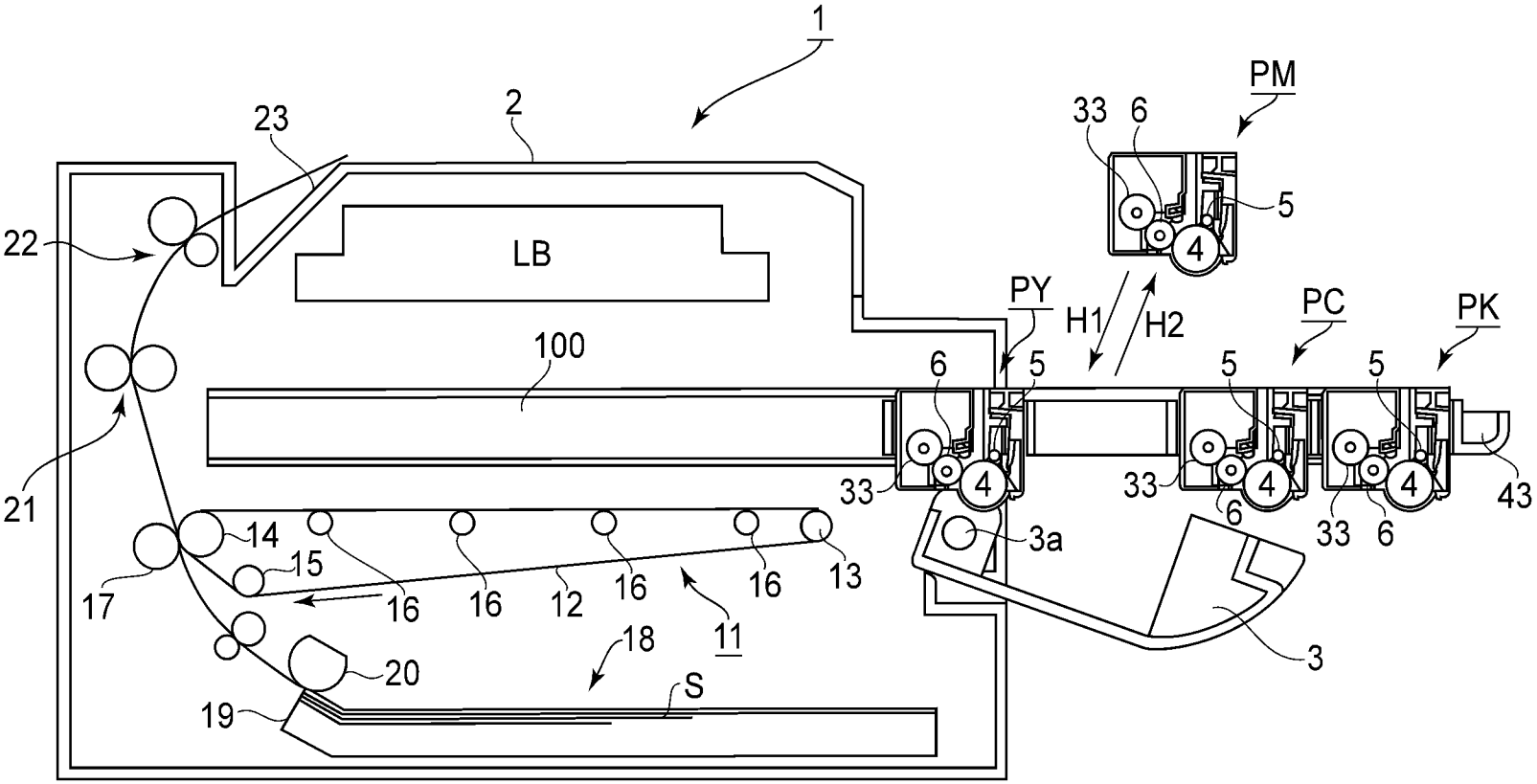
FIG. 6 is a schematic section 2 illustrating a mounting and demounting structure of the process cartridge relative to the main assembly of the image forming apparatus.

FIG. 5 is a schematic sectional view in which the cartridge tray 43 is drawn out of the main assembly 2, and the cartridges P are detachably mountable. FIG. 6 is a schematic sectional view illustrating the mounting and demounting operation of the cartridge P relative to the cartridge tray 43.

The cartridge tray 43 is provided in the main assembly 2. As shown in FIG. 5, the cartridge tray 43 is linearly movable (pushed in and pulled out) along the rail member 100 in the directions G1, G2 which are substantially horizontal direction. The cartridge tray 43 can take the mounted position which is inside the main assembly 2 and the drawn-out position drawn out of the mounted position.

The mounting operation of the cartridge P (PY, PM, PC, PK) to the main assembly 2 will be described. The door 3 is opened by rotating it about a hinge shaft 3*a*, and the cartridge tray 43 is moved in the direction of an arrow G1 in FIG. 5 to place the cartridge tray 43 in the drawn-out position.

Here, in interrelation with the opening operation of the door 3, the drum driving couplings 4*a* of the cartridges P and the developing drive couplings 42*a* of the cartridges P are released from the connections with the main assembly of the apparatus. The cleaning device 8 of each cartridge P is released from the pressing to the positioning portion (unshown) of the main assembly side. By movement of the rail member 100 or the intermediary transfer belt unit 11, the photosensitive drum 4 of each cartridge P is spaced from the transfer belt 12. In this state, the movement of the cartridge tray 43 from the mounted position inside the main assembly 2 to the drawn-out position is enabled.

In the state that the cartridge tray 43 has been moved to the drawn-out position, the cartridges P can be exchanged and can be mounted and demounted relative to the cartridge tray 43. The cartridge P is taken out in the direction of an arrow H2 of FIG. 6 from the cartridge tray 43, and it is mounted in the direction of an arrow H1 on the cartridge tray 43, and it is kept there. After a cartridge P o the tray is taken out in the direction of an arrow H2 of FIG. 6 from the cartridge tray 43 and a new cartridge P is mounted in the direction of the arrow H1, the cartridge tray 43 is pushed into the main assembly 2 to a sufficient extent. Then, the door 3 is closed.

In interrelation with the closing operation of the door 3, the contact between the transfer belt 12 and the photosensitive drum 4 of the cartridges P are established by the movement of the rail member 100 or the intermediary transfer belt unit 11.

The cleaning device 8 of the cartridge P is pressed against the positioning portion (unshown) of the main assembly. The drum driving coupling 4*a* and the developing drive coupling 42*a* of each cartridge P is brought into connection with the main assembly side. By this, the cartridges P are mounted to the predetermined mounted positions relative to the main assembly 2, by which the image forming operation of the image forming apparatus 1 is enabled.

(Structure of the Developing Device 9)

Figure 7:
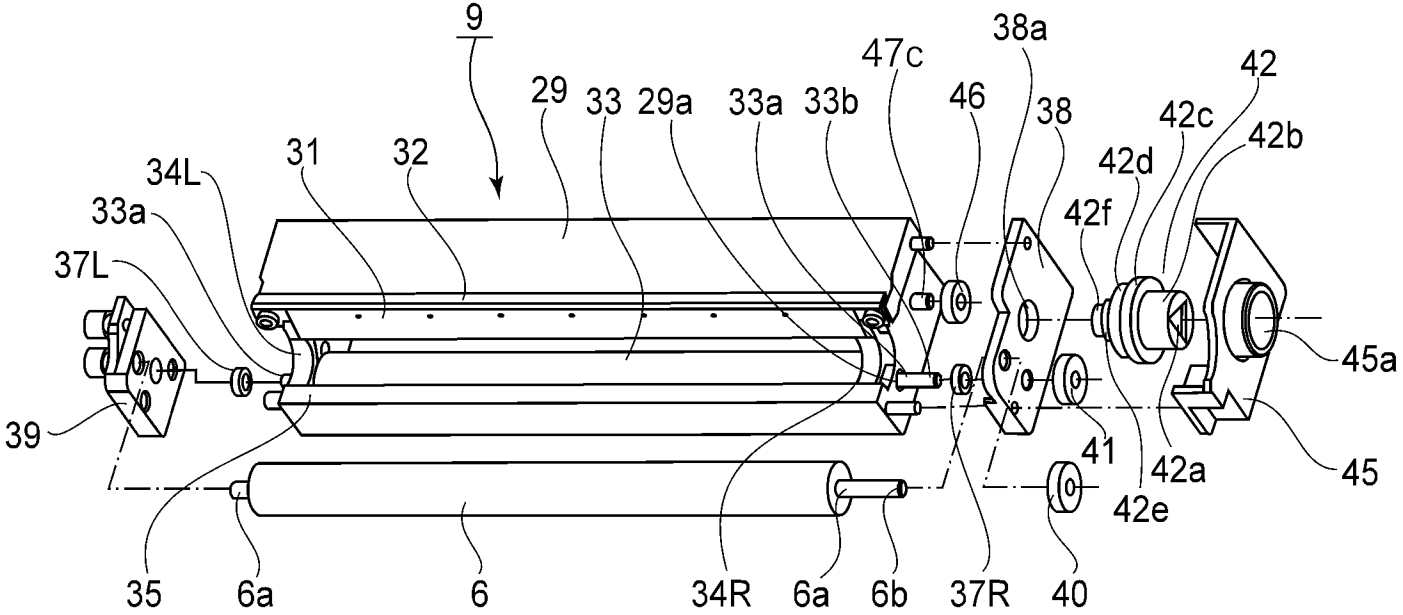
FIG. 7 is an exploded perspective view of a developing device.

FIG. 7 is an exploded perspective view of the developing device 9. As shown in FIGS. 4, 7, the developing device 9 is elongated in the axial direction of the developing roller 6 as the developing means. The developing device 9 comprises, in addition to the developing roller 6, a developing device frame 29, a developing blade 31, a toner supplying roller 33, development end portion sealing members 34R, 34L, a flexible sheet 35, supplying roller shaft seals 37R, 37L, a toner stirring member 47 and so on.

The developing device frame 29 includes a toner accommodation chamber 29*c* for accommodating the toner, and is provided with an opening 29*b* for discharging the toner from the toner accommodation chamber 29*c*. The developing blade 31 is a layer thickness regulation member for regulating a layer thickness of the toner deposited on the developing roller 6. The toner supplying roller 33 is a rotatable developer feeding member for supplying the toner to the developing roller 6. The toner stirring member 47 is a rotatable developer stirring member for stirring the toner accommodated in the toner accommodation chamber (developer accommodating chamber).

The developing roller 6 and the toner supplying roller 33 are disposed in the opening 29*b* of the developing device frame 29, the opposite end portions of the shaft of these rollers are supported rotatably by a driving side bearing 38 and a non-driving side bearing 39 mounted to both side surfaces of the developing device frame 29.

The driving side end portion 6*b* of the core material (shaft) 6*a* of the developing roller 6 is provided with a developing roller gear (developer carrying member gear) 40 fixed thereto concentrically. The driving side end portion 33*b* of the core material (shaft) 33*a* of the toner supplying roller 33 is provided with a toner supplying roller gear (developer feeding member gear) 41 fixed thereto concentrically. The developing roller gear 40 and the toner supplying roller gear 41 are in meshing engagement with the developing drive input gear 42.

The toner stirring member 47 functions to stir and feed the toner in the toner accommodation chamber 29*c* to the toner supplying roller 33. The toner stirring member 47 includes a stirring shaft 47*a* and a stirring sheet 47*b*. Stirring sheet 47*b* is made of plastic resin film such as polyethylene terephthalate or polypropylene or the like and is fixed to the stirring shaft 47*a* by a double coated tape, a welding, an adhesive material or the like. The driving side end portion 47*c* of the stirring shaft 47*a* is provided with a toner stirring gear (developer stirring member gear) 46 which is in meshing engagement with the developing drive input gear 42.

The developing drive input gear 42 is provided with the developing drive coupling 42*a*, and is engaged with the drive output coupling (unshown) of the main assembly 2 to transmit the driving force from the driving motor (unshown) of the main assembly 2. By this, the developing roller 6, the toner supplying roller 33 and the toner stirring member 47 are rotated in the predetermined directions at predetermined speeds. The detail of the developing drive input gear 42 will be described hereinafter.

The developing blade 31 is an elastic thin metal plate having a thickness of 0.1 mm, and is elongated in the axial direction of the developing roller 6. The developing blade 31 is supported by a supporting metal plate 32, which is mounted to the developing device frame 29. The developing blade 31 and the supporting metal plate 32 constitute a developing blade unit 30. A free end of the developing blade 31 with respect to a widthwise direction contacts the developing roller 6 counterdirectionally to the rotational moving direction of the developing roller (direction of arrow E in FIG. 3). Designated by reference numeral 36 is a developing blade bottom seal.

As shown in FIG. 7, the development end portion sealing members 34R, 34L are disposed at the opposite end portions of the opening 29*b* of the developing device frame 29 to prevent toner leakage through the gaps between the developing blade 31 and the developing device frame 29 and between the developing roller 6 and the developing device frame 29.

The flexible sheet 35 is provided longitudinally extending side surface opposing the developing blade 31 at opening 29*b* of the developing device frame 29 and is contacted to the developing roller 6 to prevent toner leakage through the gap between the developing device frame 29 and the developing roller 6. The supplying roller shaft seals 37R, 37L are mounted to a portion exposed outwardly of the developing device frame 29 adjacent to the core material (shaft) 33*a* of the toner supplying roller 33 to prevent the toner leakage through the gap between a core material 33*a* and a hole 29*a* of the developing device frame 29 through which the core material penetrates.

As described hereinbefore, the developing device 9 is supported swingably by a shaft W1 between the driving side covering member 24 and the non-driving side covering member 25. The cleaning unit 8 and the developing device 9 are connected with each other by the shaft W1. The developing device 9 is urged rotationally about the shaft W1 by the urging member (unshown) so that the developing roller 6 contacts the photosensitive drum 4 of the cleaning unit 8 at a predetermined urging force in a free state. The developing drive coupling 42*a* is coaxial with the axis b of the shaft W1.

During image forming operation, the toner in the developing device frame 29 is applied on the developing roller 6 by rubbing between the toner supplying roller 33 and the developing roller 6 by drive. The developing blade 31 regulates a thickness of the toner layer formed on the peripheral surface of the developing roller 6, and applies charge to the toner by triboelectric charging by friction between the developing roller 6 and the press-contacted developing blade 31. The charged toner on the developing roller 6 is deposited onto the electrostatic latent image on the photosensitive drum 4 in the contact portion between the developing roller 6 and the photosensitive drum 4.

(Structure of the Developing Drive Transmission)

Figure 1:
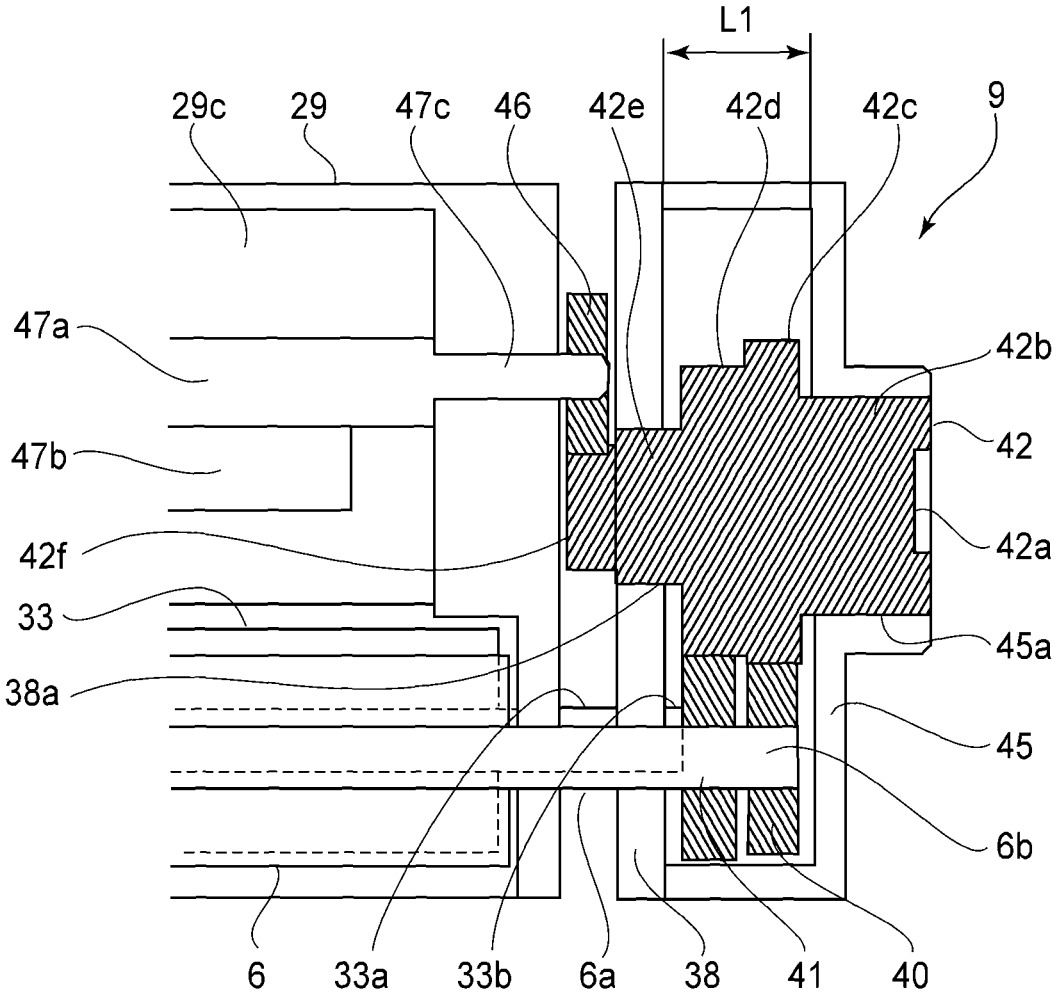
FIG. 1 is a schematic sectional view of major parts of a developing device in a process cartridge according to an embodiment of the present invention (schematic sectional view across a rotation axis of a developing drive input gear).
Figure 8:
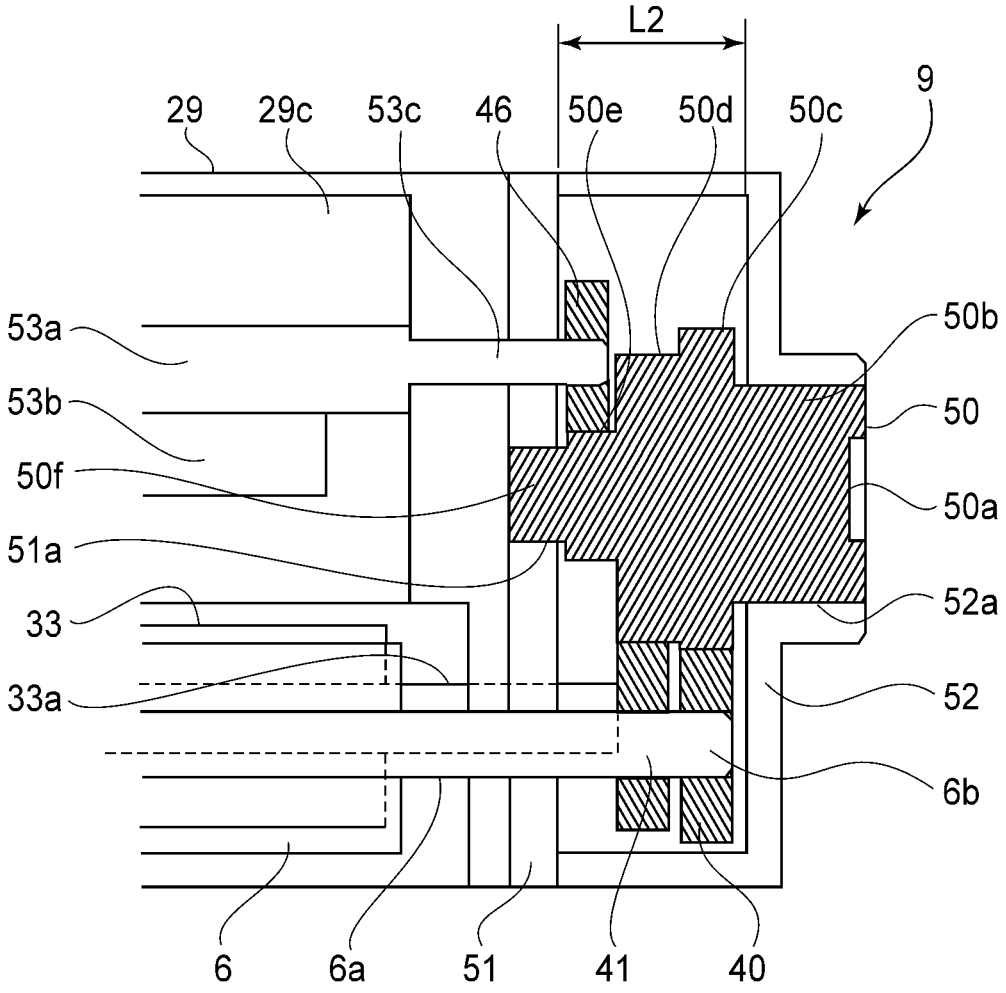
FIG. 8 is a schematic sectional view showing a section across the rotation axis of the developing drive input gear of a developing device of a comparison example.
Figure 9:
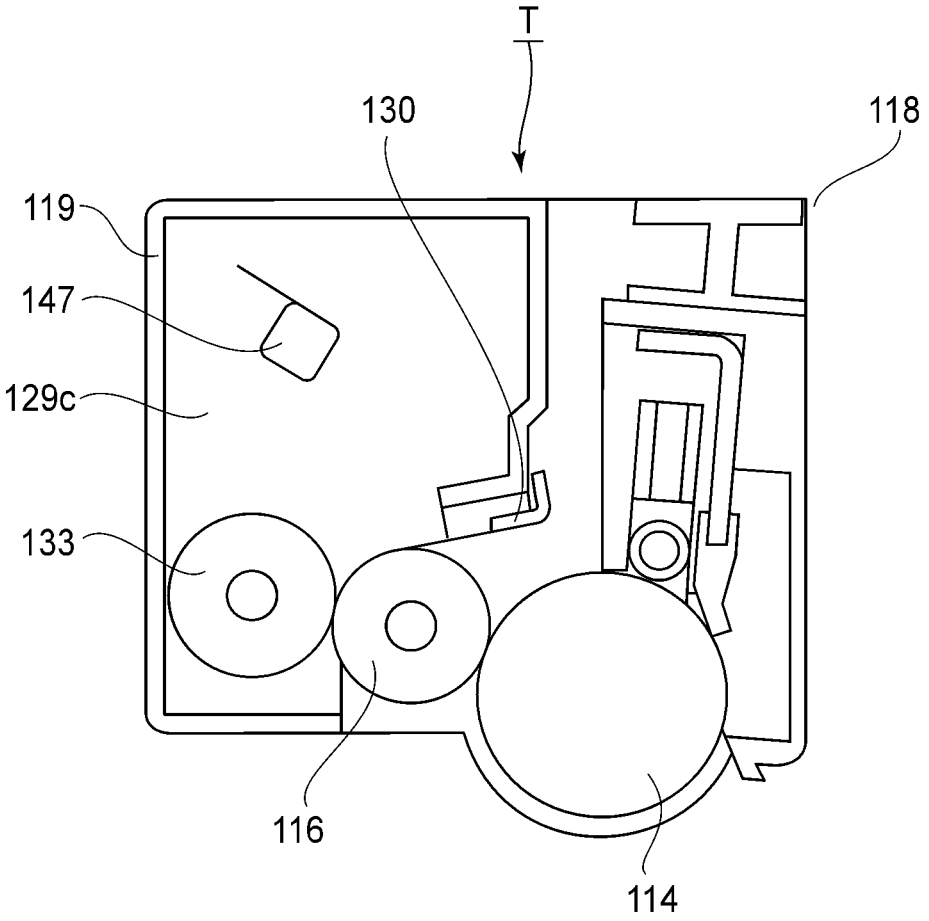
FIG. 9 is a schematic sectional view of a known process cartridge.
Figure 10:
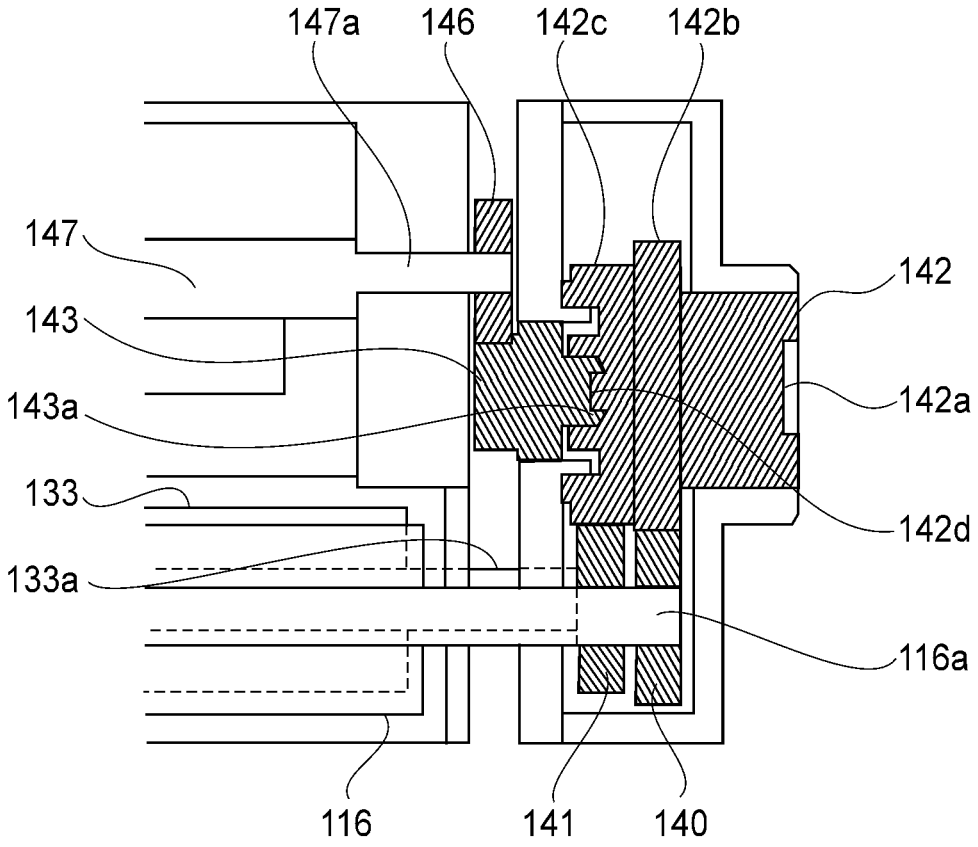
FIG. 10 is a schematic sectional view showing a section across the rotation axis of the developing drive input gear of the known developing device.

Referring to FIGS. 1, 7 and 8, the structure for developing drive transmission will be described. FIG. 1 is a schematic sectional view taken along a section passing through the rotation axis of the developing drive input gear 42 of the developing device 9. FIG. 8 is a schematic sectional view taken along a section passing through a rotation axis of a developing drive input gear of a developing device of a comparison example.

In the state that is cartridge P is mounted to a mounting portion of the main assembly 2, the cleaning unit 8 is positioned to the positioning portion (unshown) of the main assembly 2 and is fixedly held.

In this state, the drum driving output coupling (unshown) of the main assembly 2 is connected with the drum driving coupling 4*a* of the cartridge P. The drum driving coupling 4*a* is rotated by the driving force of the drum driving output coupling. By this, the photosensitive drum 4 is rotated in the predetermined direction at the predetermined speed.

The developing drive coupling 42*a* of the cartridge P is connected with the developing drive output coupling (unshown) of the main assembly 2. The developing drive coupling 42*a* is rotated by the driving force of the developing drive output coupling. By this, the developing roller 6, the toner supplying roller 33 and the toner stirring member 47 are rotated in a predetermined direction at a predetermined speed (directions of arrows E, F and G).

The developing drive input gear 42 as the developing drive inputting member is a triple gear for receiving the driving force from the driving source of the main assembly 2 and transmitting the driving force to the developing roller gear 40, the toner supplying roller gear 41 and the toner stirring gear 46, simultaneously.

The developing drive input gear 42 includes the developing drive coupling 42*a* for receiving the driving force from the developing drive output coupling of the main assembly side, the first portion-to-be-supported 42*b*, and the first gear 42*c* engaged with the developing roller gear 40, in the order named from the driving side in the axial direction of the developing drive input gear 42. Further, it includes a second gear 42*d* engaging with the toner supplying roller gear 41, a second portion-to-be-supported 42*e*, and a third gear 42*f* engaging with the toner stirring gear 46. The first portion-to-be-supported 42*b*, the first gear 42*c*, the second gear 42*d*, the second portion-to-be-supported 42*e* and the third gear 42*f* are integrally molded.

For better moldability of the developing drive input gear 42, the outer diameter of the second gear 42*d* is smaller than the outer diameter of the first gear 42*c*, and the outer diameter of the third gear 42*f* is smaller than the outer diameter of the second gear 42*d*. The developing roller gear 40, the toner supplying roller gear 41, the toner stirring gear 46 and the first-third gears are helical gears. Because of these helicities, when the developing drive input gear 42 rotates, the developing drive input gear 42 is thrusted toward the driving side in the axial direction of the developing drive input gear 42, and the developing roller gear 40, the toner supplying roller gear 41 and the toner stirring gear 46 are thrusted toward the non-driving side.

The developing drive input gear 42 is supported rotatably by a supporting portion 45*a* of a drive covering member 45 which is a first supporting member provided having the first portion-to-be-supported 42*b* at the one end portion side with respect to the axial direction of the developing drive input gear 42. The second portion-to-be-supported 42*e* is supported rotatably by a supporting portion 38*a* of a driving side bearing 38 which is a second supporting member provided at the another end portion side with respect to the axial direction of the developing drive input gear 42. That is, the developing drive input gear 42 is supported rotatably at the opposite end portions by the drive covering member 45 and the driving side bearing 38 (FIGS. 1, 7).

The first gear 42*c* and the second gear 42*d* of the drive input gear 42 are supported at the opposite end portions between the drive covering member 45 and the driving side bearing 38, and the third gear 42*f* is supported only by the driving side bearing 38 (cantilevered).

Here, a distance between the drive covering member 45 and the driving side bearing 38 is L1 (FIG. 1). A developing drive input gear 50 shown in FIG. 8 as the comparison example, a first gear 50*c*, a second gear 50*d* and a third gear 50*e* are disposed between a driving side bearing 51 and a drive covering member 52. Here, a distance between the driving side bearing 51 and the drive covering member 52 is L2.

In this embodiment of the present invention, between the drive covering member 45 and the driving side bearing 38 as a supporting member for the developing drive input gear 42, two gears, namely, the first gear 42*c* and the second gear 42*d* of the developing drive input gear 42 are supported. On the contrary, in the comparison example (FIG. 8), three gears, namely, the first gear 50*c*, the second gear 50*d* and the third gear 50*e* are supported. Therefore, L2>L1.

Thus, the distance L1 between the driving side bearing 38 and the drive covering member 45 is shortened, and between them, the first gear 42*c* and the second gear 42*d* of the developing drive input gear 42 for driving the developing roller 6 and the toner supplying roller 33 which are important for the image formation are disposed and supported at the opposite end portions. Therefore, a deformation of the developing drive input gear 42 and/or a tilting are reduced, and the possibility of an image defect attributable to a defect engagement between the gears is reduced.

As described in the foregoing, the developing drive input gear 42 is a triple gear which simultaneously transmits the driving force to the developing roller gear 40, the toner supplying roller gear 41 and the toner stirring gear 46. The first gear 42*c* and the second gear 42*d* of the developing drive input gear 42 are disposed between the drive covering member 45 which is the first supporting member and the driving side bearing 38 which is the second supporting member and are supported at the opposite end portions, and are engaged with the developing roller gear 40 and the toner supplying roller gear 41. Furthermore, the third gear 42*f* is supported only by the driving side bearing 38, and is engaged with the toner stirring gear 46.

By this, the number of the cartridge P can be reduced, and the downsizing can be accomplished, and in addition, a drive transmission stabilization of the drive input gear 42 during the image forming operation can be realized.

The first gear 42*c* and the second gear 42*d* of the developing drive input gear 42 are arranged in this order from a driving side in the axial direction of the developing drive input gear 42, but this order is not inevitable. If the first gear 42*c* and the second gear 42*d* are supported at the opposite end portions by the driving side bearing 38 and the drive covering member 45, the second gear 42*d* and the first gear 42*c* may be arranged in this order from the driving side in the axial direction of the developing drive input gear 42.

In addition, the first supporting member is the drive covering member 45, and the second supporting member is the driving side bearing 38, but this is not inevitable. For example, the developing roller 6 and toner supplying roller 33 may be supported by the developing device frame 29 as the first supporting member, and the second supporting member may be the driving side bearing 38. Furthermore, the first supporting member and the second supporting member may be separate members. Even with such structure, the effects of the present invention can be provided.

The meshing engagement between the toner stirring gear 46 and the third gear 42*f* of the developing drive input gear 42 is not inevitable to the present invention. In order to change the rotational speed and/or the rotational moving direction of the toner stirring member 47, an idler gear may be provided in meshing engagement with the third gear 42*f* and the toner stirring gear 46.

(Other Embodiments)

(1) in Embodiment 1, the process cartridge includes both of the cleaning unit 9 and the developing device 29. However, this is not inevitable. The process cartridge may include the rotatable image bearing member and the developing device 29 for developing the latent image with the developer.

(2) the developing device 29 may be a developing cartridge which is detachably mountable to the main assembly of the image forming apparatus, independently.

(3) the developing device 29 may be fixed to the image forming apparatus.

(4) in Embodiment 1, the process cartridge, the developing cartridge and the developing device are for the electrophotographic image forming apparatus using the electrophotographic photosensitive member as the image bearing member, but the image forming apparatus is not limited to the example. The present invention is applicable to a process cartridge, a developing cartridge and a developing device for an electrostatic recording type image forming apparatus using a dielectric member for electrostatic recording as the image bearing member and to a process cartridge, a developing cartridge and a developing device for a magnetic recording type image forming apparatus using a magnetic member for magnetic recording as the image bearing member.

These and other objects, features, and advantages of the present invention will become more apparent upon consideration of the following DESCRIPTION OF THE PREFERRED EMBODIMENTS: of the present invention, taken in conjunction with the accompanying drawings.

While the invention has been described with to reference to the structures disclosed herein, it is not confined to the details set forth and this application is intended to cover such modifications or changes as may come within the purpose of the improvements or the scope of the following claims.

What is claimed is:

1. A process cartridge detachably mountable to a main assembly of an image forming apparatus for forming an image on a recording material, said process cartridge comprising:

a rotatable image bearing member for carrying a latent image; and a developing device for developing the latent image with a developer, said developing device including:

a rotatable developer carrying member for developing the latent image formed on said image bearing member with a developer, a rotatable developer feeding member for supplying the developer to said developer carrying member, a developer accommodating chamber for accommodating the developer, a rotatable developer stirring member for stirring the developer accommodated in said developer accommodating chamber, a developer carrying member gear provided on a shaft of said developer carrying member, a developer feeding member gear provided on a shaft of said developer feeding member, a developer stirring member gear provided on a shaft of said developer stirring member, a transmission member for transmitting a driving force to said developer carrying member, said developer feeding member and said developer stirring member, and first and second supporting portions for rotatably supporting said transmission member, wherein said transmission member includes a first gear for transmitting the driving force to said developer carrying member gear, a second gear for transmitting the driving force to said developer feeding member gear, and a third gear for transmitting the driving force to said developer stirring member gear, in which said first gear, said second gear and said third gear are integrally molded, and wherein said first gear and said second gear are between said first supporting portion and said second supporting portion.

2. A process cartridge according to claim 1, wherein said third gear is not between said first supporting portion and said second supporting portion.

3. A process cartridge according to claim 1, wherein said first gear has an outer diameter that is larger than an outer diameter of said second gear.

4. A process cartridge according to claim 1, wherein said first gear has an outer diameter that is larger than an outer diameter of said third gear.

5. A process cartridge according to claim 1, wherein said second gear has an outer diameter that is larger than an outer diameter of said third gear.

6. A process cartridge according to claim 1, wherein said first gear has an outer diameter that is larger than an outer diameter of said second gear, wherein the outer diameter of said second gear is larger than an outer diameter of said third gear, and wherein said first, second and third gears are arranged in the order named from an outside toward an inside in a longitudinal direction of said developer carrying member.

7. A developing apparatus comprising:

a rotatable developer carrying member for developing a latent image formed on an image bearing member;

a rotatable developer feeding member for supplying the developer to said developer carrying member;

a developer accommodating chamber for accommodating the developer;

a rotatable developer stirring member for stirring the developer accommodated in said developer accommodating chamber;

a developer carrying member gear provided on a shaft of said developer carrying member;

a developer feeding member gear provided on a shaft of said developer feeding member;

a developer stirring member gear provided on a shaft of said developer stirring member;

a transmission member for transmitting a driving force to said developer carrying member, said developer feeding member and said developer stirring member; and first and second supporting portions for rotatably supporting said transmission member, wherein said transmission member includes a first gear for transmitting the driving force to said developer carrying member gear, a second gear for transmitting the driving force to said developer feeding member gear, and a third gear for transmitting the driving force to said developer stirring member gear, in which said first gear, said second gear and said third gear are integrally molded, wherein said first gear and said second gear are between said first supporting portion and said second supporting portion.

8. A developing apparatus according to claim 7, wherein said third gear is not between said first supporting portion and said second supporting portion.

9. A developing apparatus according to claim 7, wherein said first gear has an outer diameter that is larger than an outer diameter of said second gear.

10. A developing apparatus according to claim 7, wherein said first gear has an outer diameter that is larger than an outer diameter of said third gear.

11. A developing apparatus according to claim 7, wherein said second gear has an outer diameter that is larger than an outer diameter of said third gear.

12. A developing apparatus according to claim 7, wherein said first gear has an outer diameter that is larger than an outer diameter of said second gear, wherein the outer diameter of said second gear is larger than an outer diameter of said third gear, and wherein said first, second and third gears are arranged in the order named from an outside toward an inside in a longitudinal direction of said developer carrying member.

13. A process cartridge detachably mountable to a main assembly of an image forming apparatus for forming an image on a recording material, said process cartridge comprising:

a rotatable image bearing member for carrying a latent image; and a developing device for developing the latent image with a developer, said developing device including:

a rotatable developer carrying member for developing the latent image formed on said image bearing member with a developer, a rotatable developer feeding member for supplying the developer to said developer carrying member, a developer accommodating chamber for accommodating the developer, a rotatable developer stirring member for stirring the developer accommodated in said developer accommodating chamber, a developer carrying member gear provided on a shaft of said developer carrying member, a developer feeding member gear provided on a shaft of said developer feeding member, a developer stirring member gear provided on a shaft of said developer stirring member, a transmission member for transmitting a driving force to said developer carrying member, said developer feeding member and said developer stirring member, and a supporting portion for rotatably supporting said transmission member, wherein said transmission member includes a first gear for transmitting the driving force to said developer carrying member gear, a second gear for transmitting the driving force to said developer feeding member gear, and a third gear for transmitting the driving force to said developer stirring member gear, in which said first gear, said second gear and said third gear are integrally molded, and wherein said supporting portion is provided between said first gear and said third gear with respect to a direction of a rotational axis of said transmission member.

14. A process cartridge according to claim 13, further comprising a second supporting portion of rotatably supporting said transmission member, wherein said first gear and said second gear are provided between said first supporting portion and said second supporting portion.

15. A process cartridge according to claim 13, wherein said first gear has an outer diameter that is larger than an outer diameter of said second gear.

16. A process cartridge according to claim 13, wherein said first gear has an outer diameter that is larger than an outer diameter of said third gear.

17. A process cartridge according to claim 13, wherein said second gear has an outer diameter that is larger than an outer diameter of said third gear.

18. A process cartridge according to claim 13, wherein said first gear has an outer diameter that is larger than an outer diameter of said second gear, wherein the outer diameter of said second gear is larger than an outer diameter of said third gear, and wherein said first, second and third gears are arranged in the order named from an outside toward an inside in a longitudinal direction of said developer carrying member.

19. A process cartridge detachably mountable to a main assembly of an image forming apparatus for forming an image on a recording material, said process cartridge comprising:

a rotatable image bearing member for carrying a latent image; and a developing device for developing the latent image with a developer, said developing device including:

a rotatable developer carrying member for developing the latent image formed on said image bearing member with a developer, a rotatable developer feeding member for supplying the developer to said developer carrying member, a developer accommodating chamber for accommodating the developer, a rotatable developer stirring member for stirring the developer accommodated in said developer accommodating chamber, a developer carrying member gear provided on a shaft of said developer carrying member, a developer feeding member gear provided on a shaft of said developer feeding member, a developer stirring member gear provided on a shaft of said developer stirring member, a transmission member for transmitting a driving force to said developer carrying member, said developer feeding member and said developer stirring member, and a supporting portion for rotatably supporting said transmission member, wherein said transmission member includes a first gear for transmitting the driving force to said developer carrying member gear, a second gear for transmitting the driving force to said developer feeding member gear, and a third gear for transmitting the driving force to said developer stirring member gear, in which said first gear, said second gear and said third gear are integrally molded, and wherein said supporting portion is provided between said second gear and said third gear with respect to a direction of a rotational axis of said transmission member.

20. A process cartridge according to claim 19, further comprising a second supporting portion of rotatably supporting said transmission member, wherein said first gear and said second gear are provided between said first supporting portion and said second supporting portion.

21. A process cartridge according to claim 19, wherein said first gear has an outer diameter that is larger than an outer diameter of said second gear.

22. A process cartridge according to claim 19, wherein said first gear has an outer diameter that is larger than an outer diameter of said third gear.

23. A process cartridge according to claim 19, wherein said second gear has an outer diameter that is larger than an outer diameter of said third gear.

24. A process cartridge according to claim 19, wherein said first gear has an outer diameter that is larger than an outer diameter of said second gear, wherein the outer diameter of said second gear is larger than an outer diameter of said third gear, and wherein said first, second and third gears are arranged in the order named from an outside toward an inside in a longitudinal direction of said developer carrying member.

25. A developing apparatus comprising:

a rotatable developer carrying member for developing a latent image formed on an image bearing member;

a rotatable developer feeding member for supplying the developer to said developer carrying member;

a developer accommodating chamber for accommodating the developer;

a rotatable developer stirring member for stirring the developer accommodated in said developer accommodating chamber;

a developer carrying member gear provided on a shaft of said developer carrying member;

a developer feeding member gear provided on a shaft of said developer feeding member;

a developer stirring member gear provided on a shaft of said developer stirring member;

a transmission member for transmitting a driving force to said developer carrying member, said developer feeding member and said developer stirring member; and a supporting portion for rotatably supporting said transmission member, wherein said transmission member includes a first gear for transmitting the driving force to said developer carrying member gear, a second gear for transmitting the driving force to said developer feeding member gear, and a third gear for transmitting the driving force to said developer stirring member gear, in which said first gear, said second gear and said third gear are integrally molded, wherein said supporting portion is provided between said first gear and said third gear with respect to a direction of a rotational axis of said transmission member.

26. A developing apparatus according to claim 25, further comprising a second supporting portion of rotatably supporting said transmission member, wherein said first gear and said second gear are provided between said first supporting portion and said second supporting portion.

27. A developing apparatus according to claim 25, wherein said first gear has an outer diameter that is larger than an outer diameter of said second gear.

28. A developing apparatus according to claim 25, wherein said first gear has an outer diameter that is larger than an outer diameter of said third gear.

29. A developing apparatus according to claim 25, wherein said second gear has an outer diameter that is larger than an outer diameter of said third gear.

30. A developing apparatus according to claim 25, wherein said first gear has an outer diameter that is larger than an outer diameter of said second gear, wherein the outer diameter of said second gear is larger than an outer diameter of said third gear, and wherein said first, second and third gears are arranged in the order named from an outside toward an inside in a longitudinal direction of said developer carrying member.

31. A developing apparatus comprising:

a rotatable developer carrying member for developing a latent image formed on an image bearing member;

a rotatable developer feeding member for supplying the developer to said developer carrying member;

a developer accommodating chamber for accommodating the developer;

a rotatable developer stirring member for stirring the developer accommodated in said developer accommodating chamber;

a developer carrying member gear provided on a shaft of said developer carrying member;

a developer feeding member gear provided on a shaft of said developer feeding member;

a developer stirring member gear provided on a shaft of said developer stirring member;

a transmission member for transmitting a driving force to said developer carrying member, said developer feeding member and said developer stirring member; and a supporting portion for rotatably supporting said transmission member, wherein said transmission member includes a first gear for transmitting the driving force to said developer carrying member gear, a second gear for transmitting the driving force to said developer feeding member gear, and a third gear for transmitting the driving force to said developer stirring member gear, in which said first gear, said second gear and said third gear are integrally molded, wherein said supporting portion is provided between said second gear and said third gear with respect to a direction of a rotational axis of said transmission member.

32. A developing apparatus according to claim 31, further comprising a second supporting portion of rotatably supporting said transmission member, wherein said first gear and said second gear are provided between said first supporting portion and said second supporting portion.

33. A developing apparatus according to claim 31, wherein said first gear has an outer diameter that is larger than an outer diameter of said second gear.

34. A developing apparatus according to claim 31, wherein said first gear has an outer diameter that is larger than an outer diameter of said third gear.

35. A developing apparatus according to claim 31, wherein said second gear has an outer diameter that is larger than an outer diameter of said third gear.

36. A developing apparatus according to claim 31, wherein said first gear has an outer diameter that is larger than an outer diameter of said second gear, wherein the outer diameter of said second gear is larger than an outer diameter of said third gear, and wherein said first, second and third gears are arranged in the order named from an outside toward an inside in a longitudinal direction of said developer carrying member.

* * * * *